United States Patent [19]

Chusid

[11] 4,158,982

[45] Jun. 26, 1979

[54] LIGHT SHOW APPARATUS

[76] Inventor: Philip E. Chusid, 6 Pebble La., Levittown, Pa. 19054

[21] Appl. No.: 814,454

[22] Filed: Jul. 11, 1977

[51] Int. Cl.[2] ..... A63J 17/00

[52] U.S. Cl. ..... 84/464; 84/DIG. 13; 353/2

[58] Field of Search ..... 84/464; 353/2; 315/241 P, 241 S; 356/23, 26, 24, 25

[56] References Cited

U.S. PATENT DOCUMENTS

| | | | |
|---|---|---|---|
| 2,607,269 | 8/1952 | Elsaesser | 353/2 |
| 3,026,449 | 3/1962 | Rappaport | 315/241 S |
| 4,000,679 | 1/1977 | Norman | 84/464 |

*Primary Examiner*—L. T. Hix
*Assistant Examiner*—S. D. Schreyer
*Attorney, Agent, or Firm*—Samuel Louis Sachs

[57] ABSTRACT

A light show apparatus for projecting an image upon a viewing surface in response to a variable sound source such as music or the like including illumination means directed through a light transmitting surface having a plurality of moveable particles disposed thereon wherein the illumination means is varied and the like transmitting surface is vibrated by vibrating means, simultaneously, to produce an ever-changing display of light projected upon the viewing surface by projection means.

23 Claims, 5 Drawing Figures

FIG. 1
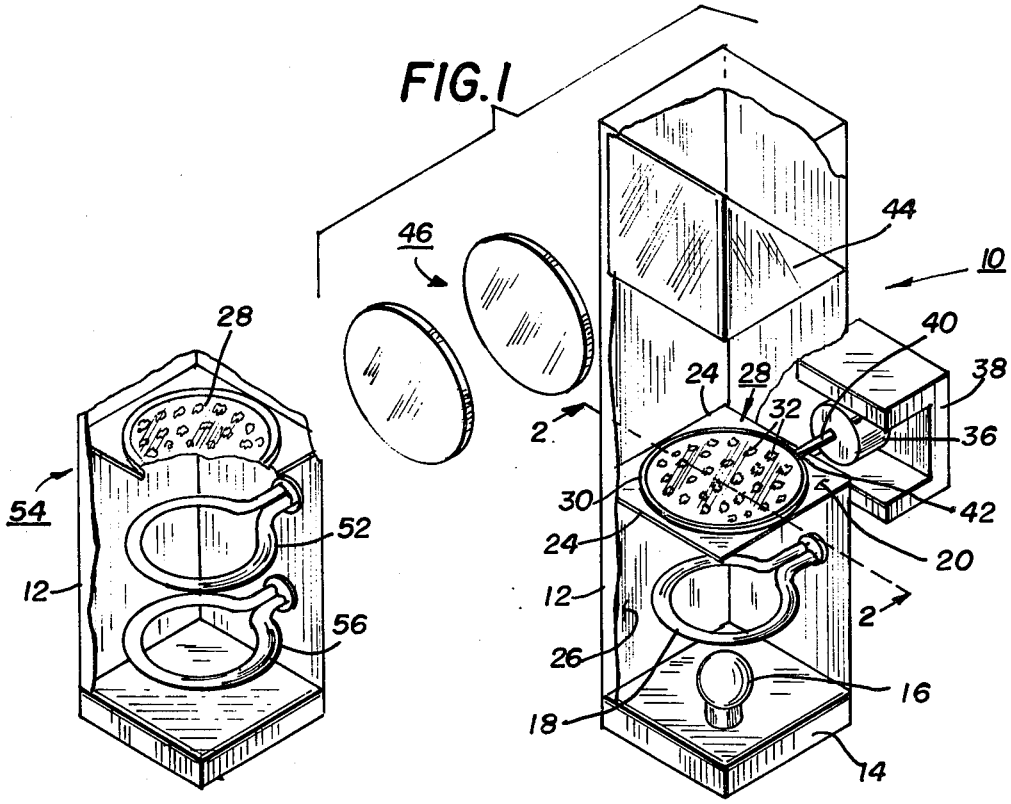
FIG. 4
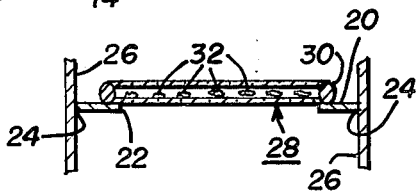
FIG. 2
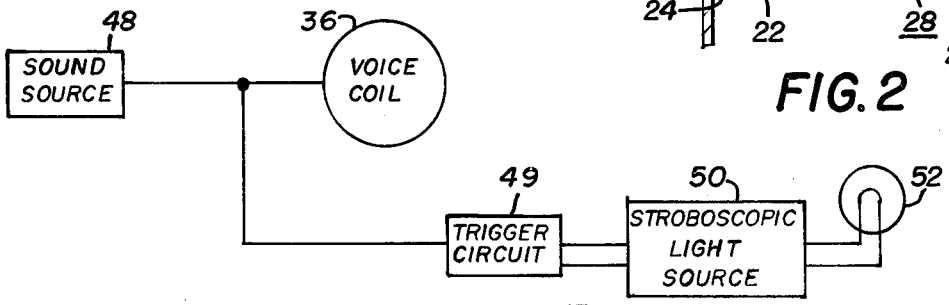
FIG. 3
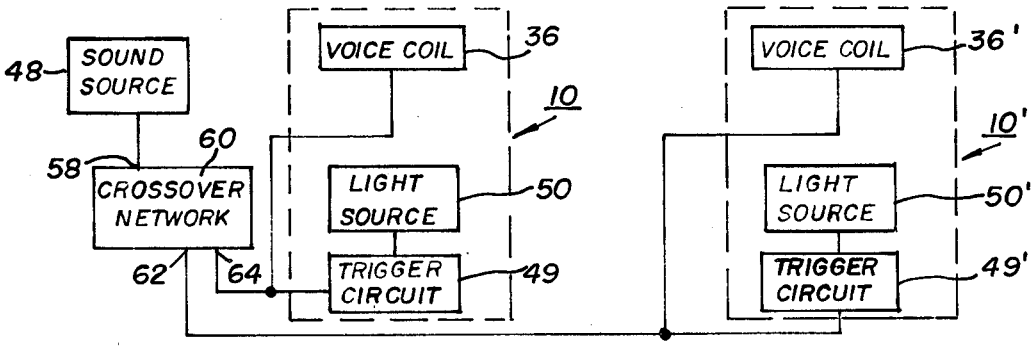
FIG. 5

LIGHT SHOW APPARATUS

BACKGROUND OF THE INVENTION

1. FIELD OF THE INVENTION

The present invention relates to apparatuses for producing light shows, and more particularly, to a light show apparatus which produces a light show that varies in response to a sound source such as music or the like.

2. DESCRIPTION OF THE PRIOR ART

The desirability of providing light shows in conjunction with musical performances is well known in the art. The simplest types of light shows produce effects which are entirely independent of the music they accompany. While these systems are in some respects pleasing, the lack of correlation between the music and the light show detracts from the overall effect.

In an attempt to produce a light show which is more closely responsive to the music which it accompanies, apparatuses have been proposed wherein individual light sources are varied in frequency of activation and intensity in response to a music source.

In an attempt to further the pleasing characteristics of light shows, several apparatuses have been proposed in the prior art which employ a constant light source and modify the light projected therefrom by the interposition of moving articles within the path of the light. Typical of such apparatuses is the projecting kaleidoscope disclosed in U.S. Pat. No. 2,607,269 issued to J. F. Elsaesser on Aug. 19, 1952. Elsaesser discloses an apparatus which includes an electrical lamp of fixed intensity that is projected through a light transmitting container having a plurality of transparent particles disposed therein. The light transmitting container is vibrated by a voice coil which is connected to a music source. As a result, a pattern of light is formed which is projected upon a viewing surface.

Similarly, U.S. Pat. No. 2,297,767 issued to D. D. Hunt on Oct. 6, 1942 discloses an electro-automatic advertising machine which projects a beam of light of a fixed intensity through a rotatable cylinder having a plurality of colored glass gems disposed therein. The light leaving the rotatable cylinder is projected upon a viewing surface by a magnifying glass.

U.S. Pat. No. 3,318,187 issued to R. Prohaska on May 9, 1967 discloses a display device which provides for the projection of light of fixed intensity upon the surface of a speaker which is covered with a plurality of moveable reflecting elements that are disposed thereon. The reflecting elements reflect the light toward a viewing screen.

U.S. Pat. No. 3,473,429 issued to W. E. Tandberg on Oct. 21, 1969 discloses a sound to color transducer which includes a plurality of colored discs rotatably mounted upon a speaker motor. A light source or fixed intensity is projected toward the colored discs and is reflected therefrom onto a viewing surface.

All of the presently known prior art apparatuses which interpose moving elements in a beam of light projected from a light source are used in conjunction with light sources of fixed intensity which are constantly on when the apparatus is in operation. Therefore, the resultant light displays can only visually depict the sound sources which they are used in conjunction with in a limited manner. If the sound source increases in amplitude or frequency, the result will merely be a greater intensity of activation of the particles or objects disposed within the path of the light. Projected light shows produced in this manner are therefore severely limited in scope since they are only modified by the degree of movement of the interposed objects and cannot closely translate the vast array of frequency shifts and amplitude shifts of a music source.

The present invention overcomes the problems associated with the prior art by providing a light show apparatus for projecting an image upon a viewing surface in response to a variable sound source wherein the light source thereof is varied in intensity and duration as well as being varied by the movement of particles disposed within the path of light projected therefrom. The light show produced by the apparatus of the present invention, which simultaneously varies the light source thereof while vibrating particles within the light path thereof, provides a spectacular and distinctive display which cannot be produced be presently known apparatuses operating independently and which dramatically visually depicts a sound source.

SUMMARY OF THE INVENTION

Therefore, a primary object of the present invention is to provide a light show apparatus for projecting an image upon a viewing surface in response to a variable sound source.

A further object of the present invention is to provide a light show apparatus which produces a light show that is closely responsive to variations of the sound source.

A still further object of the present invention is to provide a light show apparatus which effectively visually depicts the variations of a sound source.

A still further object of the present invention is to provide a light show apparatus which is ideally suited for use with a sound source such as music or the like.

Still another object of the present invention is to provide a light show apparatus which is suited for use in large scale displays such as a discotheque or the like.

Still another further object of the present invention is to provide a light show apparatus wherein the image projected thereby is not limited in intensity because of the configuration thereof.

Another further object of the present invention is to provide a light show apparatus which may be employed in a system of several such apparatuses.

Another still further object of the present invention is to provide a light show apparatus wherein the visual effects produced whereby are as dramatic as the audio effects of the sound source to which the apparatus is coupled.

Another object of the present invention is to provide a light show apparatus which is simple in design, inexpensive to manufacture, and durable.

These objects, as well as further objects and advantages, of the present invention will become readily apparent after reading the description of a non-limiting illustrative embodiment and the accompanying drawing.

A light show apparatus for projecting an image upon a viewing surface in response to a variable sound source according to the principles of the present invention includes illumination means; means for varying the illumination means responsive to the variation of the sound source; a light transmitting surface disposed to permit light from the illumination means to pass therethrough; a plurality of particles disposed upon the light transmitting surface, the particles being free to move upon the surface; means for vibrating the light transmitting surface responsive to the variation of the sound source, the vibration of the light transmitting surface causing movement of the particles thereon; and means for projecting the light passing through the light transmitting surface upon the viewing surface.

BRIEF DESCRIPTION OF THE DRAWING

In order that the present invention may be more fully understood it will now be described, by way of example, with reference to the accompanying drawing in which:

FIG. 1 is a partially broken away pictorial representation of the preferred embodiment incorporating the principles of the present invention therein;

FIG. 2 is a cross-sectional view taken substantially along the lines 2—2 of FIG. 1;

FIG. 3 is a schematic of the present invention;

FIG. 4 is a partially broken away pictorial represntation of an alternate embodiment of the present invention; and FIG. 5 is a schematic of still another alternate embodiment of the present invention.

DESCRIPTION OF THE PREFERRED EMBODIMENT

Referring now to the figures, and more particularly to FIG. 1 thereof, there is illustrated therein a light show apparatus 10 which is employed for projecting an image upon a viewing surface in response to a variable sound source. The light show apparatus 10 includes an elongated housing 12 having a base portion 14. An incandescent lamp 16 is mounted upon the base 14 and is powered as hereinafter described. A flashtube 18 is mounted within the housing 12 and is the light emitting component of a stroboscopic light source, not shown. Mounted above the flashtube 18 is a semi-resilient plate 20 having a central aperture 22 disposed therethrough as illustrated in FIG. 2. The edges 24 of the semi-resilient plate 20 are fixedly secured to the interior walls 26 of the elongated housing 12 by a suitable adhesive or the like as further illustrated in FIG. 2.

A transparent plate 28, which is preferably disc-like as illustrated, is provided with an annular rim 30 that rests upon the upper surface of the semi-resilient plate 20. The transparent plate 28 may be tinted in any manner if desired and may be provided with translucent portions. The annular rim 30 is dimensioned to preclude evacuation of a plurality of particles 22 from the upper surface 34 thereof. The particles 32 are preferably a granular material, as illustrated, and may be transparent, translucent, or opaque. Furthermore, the particles 32 may be clear or colored as desired.

A voice coil 36 is mounted within a frame 38 and is fixedly secured to the elongated housing 12 and provides an element 40 which moves responsive to the application of an electrical impulse from a sound source to the voice coil 36. An end 42 of the element 40 is fixedly secured to the annular rim 30 of the transparent plate 28 so that when the voice coil 36 is activated, movement of the element 40 will cause vibration of the transparent plate 28 and therefore movement of the particles 32 disposed thereon.

A prism 44 is disposed within the housing 12 and is provided to reflect and/or, if desired, refract light which emanates from the flashtube 18 and the incandescent lamp 16 through the transparent plate 28. A lens system 46 is provided to focus the light passing through the prism 44 on a suitable viewing surface, not shown. Although prism 44 and lens system 46 are illustrated in a particular configuration, any suitable system of mirrors and lenses, well known in the optical arts, may be employed.

FIG. 2 illustrates the manner in which the transparent plate 28 and the particles 32 disposed thereon rest upon a semi-resilient plate 20 fixedly secured on the edges 24 thereof to the interior walls 26 of the housing 12.

FIG. 3 illustrates the electrical connections between the components of the light show apparatus 10 hereinbefore described. A sound source 48 such as a music generating apparatus or the like is coupled to the voice coil 36 and the input of a trigger circuit 49. The voice coil responds to changes in the amplitude and frequency of the sound source 48 and correspondingly vibrates the transparent plate 28 responsive thereto. The trigger circuit 49 is of conventional design and translates the variations in amplitude, frequency, or both of the sound source 48 so that they may be used to control the duration of flashes provided by a stroboscopic light source 50 and a flashtube 52 thereof. Alternately, the trigger circuit 49 may be used to vary the intervals between the multiple flashes provided by the stroboscopic light source 50 emanating from the flashtube 52 thereof. Since the voice coil 36 and the trigger circuit 49 are both coupled to the sound source 48, the vibration of the particles 32 and the triggering of the stroboscopic light source 50 will be in synchronization and will visually depict all variations of the sound source 48 upon a viewing surface. The flashtube 52 may be of the xenon type or the like.

If desired, the trigger circuit 49 and the stroboscopic light source 50 may be replaced by an incandescent lamp and a suitable circuit for varying the intensity or activation thereof. In that event, the suitable circuit would also be coupled directly to the sound source 48.

FIG. 4 illustrates an alternate embodiment of the light show apparatus 10, a light show apparatus 54. The light show apparatus 54 incorporates the same elements as the light show apparatus 10 with the exception of the deletion of the incandescent lamp 16 and the addition of a second flashtube 56 in addition to the flashtube 52. The flashtube 56 may be coupled to the same trigger circuit as the flashtube 52 or may be coupled to an independent trigger circuit, not illustrated.

FIG. 5 illustrates the employment of a pair of light show apparatuses 10 and 10'. The sound source 48 is coupled to the input 58 of a frequency crossover network 60. The crossover network 60 provides a pair of outputs 62 and 64. The crossover network 60 is of a conventional capacitor and choke design which may include resistors. The output 64 of the crossover network 60 is coupled to the voice coil 36 and the input of the trigger circuit 49. The light source 50 is coupled to the output of the trigger circuit 49 in the same manner as hereinbefore described. The output 62 of the crossover network 60 is coupled to the voice coil vibrator 36' and to the input of the trigger circuit 49'. The light source 50' is coupled to the output of the trigger circuit 49' in the same manner as the light source 50 is coupled to the trigger 49.

In use, referring to FIG. 1, the incandescent lamp 16 is provided with a constant source of voltage so that it provides an even level of illumination. The voice coil 36 and the trigger circuit 49 are connected to the sound source 48, such as a music producing apparatus, or the like. In response to variations in the sound source 48, the voice coil 36 causes vibration of the transparent plate 28 and therefore the particles 32 disposed thereon. Simultaneously, the trigger circuit 49 varies either the duration of the flashes of the stroboscopic light 50, the intervals therebetween, or both.

Illumination from the flashtube 52 of the stroboscopic light source 50 and the incandescent lamp 16 are directed through the vibrating transparent plate 28 and toward the prism 44. The light is then reflected from the prism 44 through the lens system 46 so that it may be projected upon a suitable viewing surface, not illustrated. The light emitted from the flashtube 52 is combined with the constant light emitted from the incandescent lamp 16 to improve total illumination provided by the light show apparatus 10. If circumstances permit, and illumination from the flashtube 52 is adequate by itself, the incandescent lamp 16 may be omitted. Alternately, if greater illumination is desired, a pair of flashtubes 52 and 56 may be employed as illustrated in FIG. 4.

It should be apparent that the light show projected from the light show apparatus 10 will dramatically and accurately depict variations of the sound source 48 since vibration of the particles 32 is simultaneously coupled with variations in the duration or variations in the frequency of flashes emanating from the stroboscopic light source 50. For instance, when the voice coil 36 provides rapid vibration of the particles 32 in response to the sound source 48, the intensity of the stroboscopic light source 50 will be increased either by variations of the duration of the flashes thereof or the time interval between the flashes thereof dependent upon the specific trigger circuit 49 selected by the user. In either event, the increased vibration of the particles will be coupled with increased perceived intensity of illumination thereby causing a dramatic visual depiction of the heightened audio of the sound source 48. If the sound source 48 produces a more mellow sound, or one of lower amplitude, the particles 32 will vibrate at a slower rate and the perceived intensity of the stroboscopic light source 50 will be correspondingly reduced.

Referring specifically to FIG. 5, when the system illustrated therein is in use, the frequency ranges of the sound source 48 are broken down into two ranges by the crossover network 60. One frequency range is fed to the light show apparatus 10 while the other frequency range is fed to the light show apparatus 10'. The light projected from the light show apparatuses 10 and 10' are preferably both directed toward the same viewing surface. As a result, a very spectacular display will be produced which further segregates and differentiates the frequency characteristics of the sound source 48. It should be apparent to one skilled in the art that any number of light show apparatuses may be employed in the system of FIG. 5 if the proper crossover network 60 is employed.

Therefore, a primary advantage of the present invention is to provide a light show apparatus for projecting an image upon a viewing surface in response to a variable sound source.

A further advantage of the present invention is to provide a light show apparatus which produces a light show that is closely responsive to variations of the sound source.

A still further advantage of the present invention is to provide a light show apparatus which effectively visually depicts the variations of a sound source.

A still further advantage of the present invention is to provide a light show apparatus which is ideally suited for use with a sound source such as music or the like.

Still another advantage of the present invention is to provide a light show apparatus which is suited for use in large scale displays such as a discotheque or the like.

Still another further advantage of the present invention is to provide a light show apparatus wherein the image projected thereby is not limited in intensity because of the configuration thereof.

Another further advantage of the present invention is to provide a light show apparatus which may be employed in a system of several such apparatuses.

Another still further advantage of the present invention is to provide a light show apparatus wherein the visual effects produced thereby are as dramatic as the audio effects of the sound source to which the apparatus is coupled.

Another advantage of the present invention is to provide a light show apparatus which is simple in design, inexpensive to manufacture, and durable.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A light show apparatus for projecting an image upon a viewing surface in response to a variable sound source comprising:
   - illumination means which comprises at least one electrically powered stroboscopic light source;
   - means for varying said illumination means responsive to the variation of said sound source;
   - a light transmitting surface disposed to permit light from said illumination means to pass therethrough;
   - a plurality of particles disposed upon said light transmitting surface, said particles being free to move upon said surface;
   - means for vibrating said light transmitting surface responsive to the variation of said sound source, the vibration of said light transmitting surface causing movement of said particles thereon; and
   - means for projecting said light passing through said light transmitting surface upon said viewing surface.

2. A light show apparatus in accordance with claim 1, where said illumination variation means comprises an electronic trigger circuit coupled on the input thereof to said sound source, said trigger circuit coupled to said stroboscopic light source for the multiple triggering thereof in response to variations of said sound source.

3. A light show apparatus in accordance with claim 2, wherein said trigger circuit varies the duration of said stroboscopic light source when triggered responsive to the variation of said sound source.

4. A light show apparatus in accordance with claim 2, wherein said trigger circuit varies the interval between said multiple triggerings of said stroboscopic light source in response to the variation of said sound source.

5. A light show apparatus in accordance with claim 1, wherein said light transmitting surface comprises a transparent plate providing an annular rim dimensioned to retain said particles upon said plate, said plate mounted upon a supporting surface by a semi-flexible support.

6. A light show apparatus in accordance with claim 1, wherein said plurality of particles comprise granular material.

7. A light show apparatus in accordance with claim 1, wherein said vibrating means comprises a voice coil electrically coupled to said sound source, said voice coil providing an element which moves responsive to said sound source, said element mechanically coupled to said light transmitting surface.

8. A light show apparatus in accordance with claim 1, wherein said projection means comprises a prism for reflecting said light passing through said light transmitting surface and at least one lens for focusing said light upon said viewing surface.

9. A light show apparatus for projecting an image upon a viewing surface in response to a variable sound source comprising:

first illumination means which comprises at least one electrically powered stroboscopic light source;

means for varying said first illumination means responsive to the variation of said sound source;

second illumination means providing constant illumination;

a light transmitting surface disposed to permit light from said first and second illumination means to pass therethrough;

a plurality of particles disposed upon said light transmitting surface, said particles being free to move upon said surface;

means for vibrating said light transmitting surface responsive to the variation of said sound source, the vibration of said light transmitting surface causing movement of said particles thereon; and means for projecting said light passing through said light transmitting surface upon said viewing surface.

10. A light show apparatus in accordance with claim 9, wherein said first illumination variation means comprises an electronic trigger circuit coupled on the input thereof to said sound source, said trigger circuit coupled to said stroboscopic light source for the multiple triggering thereof in response to variations of said sound source.

11. A light show apparatus in accordance with claim 10, wherein said trigger circuit varies the duration of said stroboscopic light source when triggered responsive to the variation of said sound source.

12. A light show apparatus in accordance with claim 10, wherein said trigger circuit varies the interval between said multiple triggerings of said stroboscopic light source in response to the variation of said sound source.

13. A light show apparatus in accordance with claim 9, wherein said light transmitting surface comprises a transparent plate providing an annular rim dimensioned to retain said particles upon said plate, said plate mounted upon a supporting surface by a semi-flexible support.

14. A light show apparatus in accordance with claim 9, wherein said plurality of particles comprise granular material.

15. A light show apparatus in accordance with claim 9, wherein said vibrating means comprises a voice coil electrically coupled to said sound source, said voice coil providing an element which moves responsive to said sound source, said element mechanically coupled to said light transmitting surface.

16. A light show apparatus in accordance with claim 9, wherein said projection means comprises a prism for reflecting said light passing through said light transmitting surface and at least one lens for focusing said light upon said viewing surface.

17. A light show apparatus in accordance with claim 9, wherein said second illumination means comprises an incandescent lamp.

18. A light show apparatus for projecting an image upon a viewing surface in response to a variable sound source comprising:

a crossover network coupled on the input thereof to said sound source, said crossover network providing at least two outputs;

at least two illumination means each of which comprise at least one electrically powered stroboscopic light source;

at least two means for independently varying said at least two illumination means responsive to said at least two outputs of said crossover network, each of said illumination variation means comprising an electronic trigger circuit each independently coupled on the input thereof to the outputs of said crossover network, each of said trigger circuits independently coupled to said stroboscopic light sources for the multiple triggering thereof in response to the output of said crossover network;

at least two independent light transmitting surfaces disposed to permit discrete lights from said at least two illumination means to discretely pass therethrough;

a plurality of particles disposed upon said light transmitting surfaces, said particles being free to move upon said surfaces;

at least two means for independently vibrating said light transmitting surfaces responsive to said at least two outputs of said crossover network, the vibration of said light transmitting surfaces causing movement of said particles thereon; and at least two means for projecting said discrete lights passing through said light transmitting surfaces upon said viewing surfaces.

19. A light show apparatus in accordance with claim 18, wherein each of said trigger circuits vary the duration of said stroboscopic light coupled thereto when triggered responsive to said output of said crossover network coupled thereto.

20. A light show apparatus in accordance with claim 18, wherein each of said trigger circuits vary the interval between said multiple triggerings of each of said stroboscopic light sources in response to the output of said crossover network coupled thereto.

21. A light show apparatus in accordance with claim 18, wherein said light transmitting surfaces each comprise a transparent plate providing an annular rim dimensioned to retain said particles upon said plate, each of said plates mounted independently upon a supporting surface by a semi-flexible support, said plurality of particles comprising granular material.

22. A light show apparatus in accordance with claim 18, wherein each of said vibrating means comprise a voice coil electrically coupled to one of said outputs of said crossover network, each of said voice coils providing an element which moves responsive to said output, said elements independently mechanically coupled to said light transmitting surfaces.

23. A light show apparatus in accordance with claim 18, wherein each of said projection means comprise a prism for reflecting said light passing through each of said light transmitting surfaces and at least one lens for focusing said light upon said viewing surface.

* * * * *

UNITED STATES PATENT AND TRADEMARK OFFICE

CERTIFICATE OF CORRECTION

PATENT NO. : 4,158,982

DATED : June 26, 1979

INVENTOR(S) : Philip E. Chusid

It is certified that error appears in the above–identified patent and that said Letters Patent are hereby corrected as shown below:

IN THE ABSTRACT:

Line 6, delete "like" and replace therefor --light--.

Column 1, line 55, delete "or" and replace therefor --of--.

Column 2, line 48, delete "whereby" and replace therefor --thereby--.

Signed and Sealed this

*Fourth* Day of *December 1979*

[SEAL]

*Attest:*

SIDNEY A. DIAMOND

*Attesting Officer*

*Commissioner of Patents and Trademarks*